US006412638B1

(12) United States Patent
Carter

(10) Patent No.: US 6,412,638 B1
(45) Date of Patent: Jul. 2, 2002

(54) DAMAGE CONTROL LEAK PAN

(75) Inventor: Frankie Lee Carter, 34401 Via San Juan #A, Capistrano Beach, CA (US) 92624

(73) Assignee: Frankie Lee Carter, Dana Point, CA (US)

( * ) Notice: Subject to any disclaimer, the term of this patent is extended or adjusted under 35 U.S.C. 154(b) by 0 days.

(21) Appl. No.: 09/528,499

(22) Filed: Mar. 20, 2000

(51) Int. Cl.[7] ..... B65D 1/34
(52) U.S. Cl. ..... 206/557; 220/571
(58) Field of Search ..... 206/557, 564, 206/372, 373; 220/570, 571

(56) References Cited

U.S. PATENT DOCUMENTS 3,231,718 A * 1/1966 Vasile ..... 206/557
3,464,832 A * 9/1969 Mullinix ..... 206/557
3,634,937 A * 1/1972 Green ..... 206/557
4,211,447 A * 7/1980 DiVincenzo ..... 180/90.6
4,966,296 A * 10/1990 Farrell ..... 206/820
5,092,469 A * 3/1992 Takata et al. ..... 206/484
5,326,020 A * 7/1994 Cheshire et al. ..... 220/657
5,489,658 A * 2/1996 Huang ..... 206/216
5,641,118 A * 6/1997 Benham ..... 229/125.35
5,651,462 A * 7/1997 Simonsen et al. ..... 206/557

* cited by examiner

*Primary Examiner*—Shian Luong
(74) *Attorney, Agent, or Firm*—Frankie Lee Carter; Hans Eric Girrbach

(57) ABSTRACT

The damage control leak pan designed to contain leaking water from defective plumbing. The leak pan contains the leaking water in it reservoir thereby preventing water damage. Said leak pan is utilized to prevent an array of damage created by water leaking into numerous areas, namely under bathroom and kitchen sinks. The leak pan is capable of being adjusted to fit into various sink areas by means of a perforated lip surrounding the upper edge of the reservoir. The leak pan solves many current problems associated with defective plumbing with and inexpensive and simple solution.

2 Claims, 1 Drawing Sheet

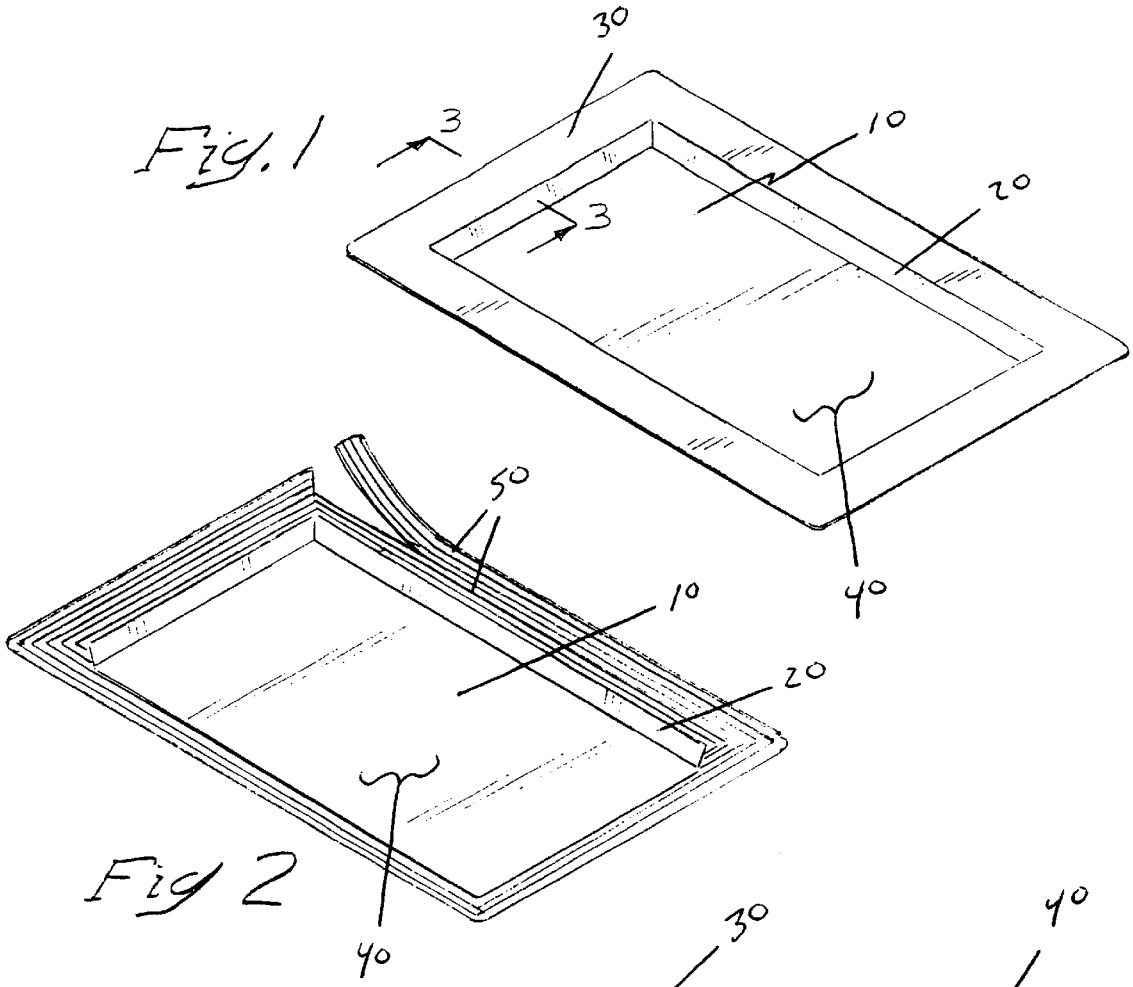
Fig. 1
Fig 2
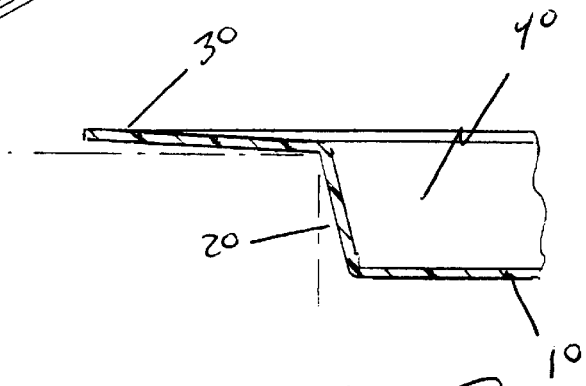
Fig. 3
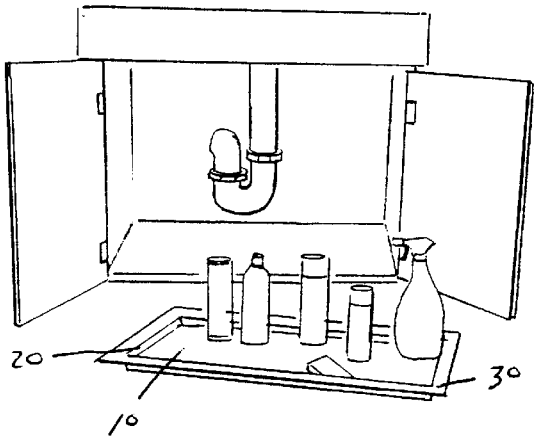
Fig. 4

DAMAGE CONTROL LEAK PAN

The present invention relates to an adjustable leak pan device utilized to prevent water damage caused by faulty plumbing. The leak pan device is easily fitted and placed beneath plumbing under kitchen, bathroom and all other plumbing areas such that the leak pan contains leaking water thereby preventing damage including, but not limited to, rotted wood, mold build-up and warped cabinet materials. The present invention has many other preventative features that are disclosed herein. Further, the leak pan is designed to conveniently fit into areas of nearly all sizes.

BACKGROUND OF THE INVENTION

Areas under plumbing, namely bathroom and kitchen sinks, are common areas of water leakage. The aforementioned water leakage leads to countless problems including, but not limited to, rotted wood, mold build-up and warped cabinet materials, odor release and rodent and insect attraction.

Nearly all people have experienced one type of faulty plumbing or another. The most common leak experienced is that under the bathroom and kitchen sink areas due to excessive usage of such sinks. Bathroom and kitchen sink cabinets are normally designed and built from wood. Unfortunately, said wood cabinets do not resist water but rather they absorb water leakage resulting in damage to the wood. The most common damages are warping and mold build-up. Warping and mold build-up both require expensive replacement of said wood cabinets. Additionally, water damage is not limited to wood cabinets but negatively affects all cabinet materials if unattended.

The present invention will be invaluable to home building contractors as well as individuals already residing in completed homes. Both will be able to inexpensively and easily use the leak pan to their benefit as described herein. Contractors will especially benefit financially and maximize their profits since they will not be liable for replacing damaged sink cabinets caused by initial overlooked plumbing leaks.

Currently there is little in the way of products on the market that prevent water damage as set forth herein. Persons are forced to replace their sink cabinets after they discover the water leakage problem too late or use some type of pot or pan to contain the leaking water from the faulty plumbing. Neither of the aforementioned solutions is truly acceptable in this day and age.

SUMMARY OF THE INVENTION

The present invention addresses and solves the aforementioned problems by conveniently containing all water leaking from plumbing areas. The leak pan disclosed herein is designed to be placed under nearly all sink cabinets regardless of their size. The leak pan utilizes perforated lips to allow the user to adjust its size for varying cabinet sizes. Further, the leak pan can be checked routinely to locate leaks that may have otherwise went undetected until too late.

The leak pan is ingeniously molded from any number of materials. However, in its preferred embodiment the leak pan is molded of sturdy plastic. The resultant sturdy leak pan has a reservoir of depth sufficient to contain leaking water over a considerable period of time. Additionally, the reservoir can be used to organize those items commonly stored under both bathroom and kitchen sinks.

The molded plastic design of the leak pan includes a lip that completely surrounds the reservoir. The lip is such that it can be adjusted by the user to allow the leak pan to be fitted into various sized sink cabinets. There are several ways to accomplish the adjustment of the lip but in its preferred embodiment the lip is designed with perforated portions that are easily removed to decrease the overall area of the leak pan. The perforated portions of the lip are designed to be easily removed by the intended user.

The installation of the leak pan also allows the user the opportunity to routinely check for water leaks thereby preventing any damage prior to the detection of the leak. Without the leak pan in place, a leak may go undetected since a wood cabinet is going to absorb the water thereby hiding the leak until it is too late.

Those skilled in the art will understand that there are numerous materials that can be utilized to mold the leak pan and numerous other methods for adjusting the size of the leak pan. The material and method disclosed herein are the preferred materials and methods respectively.

Accordingly, the damage control leak pan comprises:

a flat bottom surface, four sides continuously extending upward from the flat bottom surface creating a reservoir capable of containing liquids, a lip designed perpendicular to the top perimeter of each of the four sides and continuously extending outward nearly parallel to the flat bottom surface.

BRIEF DESCRIPTION OF THE DRAWINGS

FIG. 1. is an overall perspective view of the present invention;

FIG. 2. is a overall perspective view of the present invention highlighting the adjustability of said invention;

FIG. 3. is a cross-sectional side view of the present invention;

FIG. 4. is a perspective view of the present invention in everyday use.

DETAILED DESCRIPTION OF THE PREFERRED EMBODIMENTS

Referring now to FIGS. 1, 2 & 3, the preferred embodiment of a damage control leak pan device according to the present invention is shown to comprise a flat bottom surface 10, four sides 20 and a lip 30.

A reservoir 40 is created by the flat bottom surface 10 and the four sides 20 extending upward and outward from the flat bottom surface 10. Said reservoir 40 is capable of containing liquids, namely water.

A lip 30 extends outward and slightly upward from the top perimeter of the four sides 20 such that the lip 30 slopes toward the reservoir 40. The slope of the lip 30 forces water falling onto the lip to be directed to the reservoir 40. The lip 30 includes numerous perforations 50 that run parallel to the outer edge of the lip 30. Said perforations 50 are such that a user can easily remove a portion of the lip 30 thereby decreasing the overall area of the leak pan. The perforations 50 are similar in design to legal pads that have the paper perforated along the top edge for easy removal.

The four sides 20 extend upward and outward so as the create the reservoir 40 as well as allow the leak pans to be conveniently stored by stacking them upon each other.

I claim:

1. A damage control leak pan comprising:

a flat bottom surface four sides extending upward and outwardly at an inclined angle from the flat bottom surface creating a reservoir capable of containing liquids, a lip aligned nearly perpendicular to a top perimeter of each of the four sides and extending outward, the lip is slightly sloped, several groups of perforations running parallel to an outer edge of the lip along a perimeter of the lip to decrease the length of the lip, the perforations begin at a corner of the leak pan.

2. A damage control leak pan comprising:

a flat bottom surface four sides extending upward and outwardly at an inclined angle from the flat bottom surface creating a reservoir capable of containing liquids, the four sides and the bottom surface allow several leak pans to be stacked upon each other for storage, a lip aligned nearly perpendicular to a top perimeter of each of the four sides and extending outward, the lip is slightly sloped, several groups of perforations running parallel to an outer edge of the lip along a perimeter of the lip to decrease the length of the lip, the perforations begin at a corner of the leak pan and extending at an 45 degree angle with respect to one side of the leak pan.

* * * * *